US005114281A

United States Patent [19]

Hartnett et al.

[11] Patent Number: 5,114,281

[45] Date of Patent: May 19, 1992

[54] MACHINE FOR BLOWING THERMAL INSULATION

[75] Inventors: Joseph F. Hartnett; Richard E. Wendt, both of St. Louis County, Mo.

[73] Assignee: Louisiana Pacific Corporation, Portland, Oreg.

[21] Appl. No.: 541,381

[22] Filed: Jun. 21, 1990

[51] Int. Cl.[5] ..... B60D 1/60

[52] U.S. Cl. ..... 406/39; 406/102; 406/135; 406/139; 222/617

[58] Field of Search ..... 406/39, 135, 102, 99, 406/139, 122; 222/617, 630, 637, 228

[56] References Cited

U.S. PATENT DOCUMENTS

| | | | |
|---|---|---|---|
| 1,473,785 | 11/1923 | Gore | 222/630 |
| 3,038,643 | 6/1962 | Van der Lely et al. | 222/228 X |
| 3,314,732 | 4/1967 | Hagan | 406/102 X |
| 3,587,938 | 6/1971 | Brown | 222/228 |
| 3,618,828 | 11/1971 | Schinella | 222/630 X |
| 3,995,775 | 12/1976 | Birkmeier et al. | 406/135 X |
| 4,071,170 | 1/1978 | Gunzel et al. | 222/630 X |
| 4,249,839 | 2/1981 | Vance | 406/109 |

FOREIGN PATENT DOCUMENTS

| | | | |
|---|---|---|---|
| 2900406 | 7/1979 | Fed. Rep. of Germany | 406/102 |

*Primary Examiner*—Margaret A. Focarino

*Assistant Examiner*—Gary C. Hoge

*Attorney, Agent, or Firm*—Gravely, Lieder & Woodruff

[57] ABSTRACT

A machine for blowing loose thermal insulation into cavities in the walls, ceilings, and floors of buildings is contained within a smooth box-like housing that is easily moved about within a house on its own wheels and is easily transported to and from a job site. The housing encloses an equipment cavity and has a hopper located above the equipment cavity, but the hopper, into which the loose insulation is placed, is octagonal so that corner channels exist within the housing between the sides of the hopper and the corners of the housing. The equipment cavity at the bottom of the housing contains a motor which rotates an agitating wheel in the hopper, and that wheel has flexible tips that sweep the loose insulation over the floor of the hopper and into a feed hole in that floor. A grate extends through the hopper above the wheel to prevent access to the wheel in the bottom of the hopper. The feed hole in the floor of the hopper opens into a carburetor that is connected to a fan, all within the equipment cavity. The fan draws air and loose insulation through the carburetor, where they mix, and discharges the airstream that is generated into a hose which passes upwardly through one of the corner channels and out of the housing at the upper end of the hopper.

21 Claims, 5 Drawing Sheets

FIG. 6.
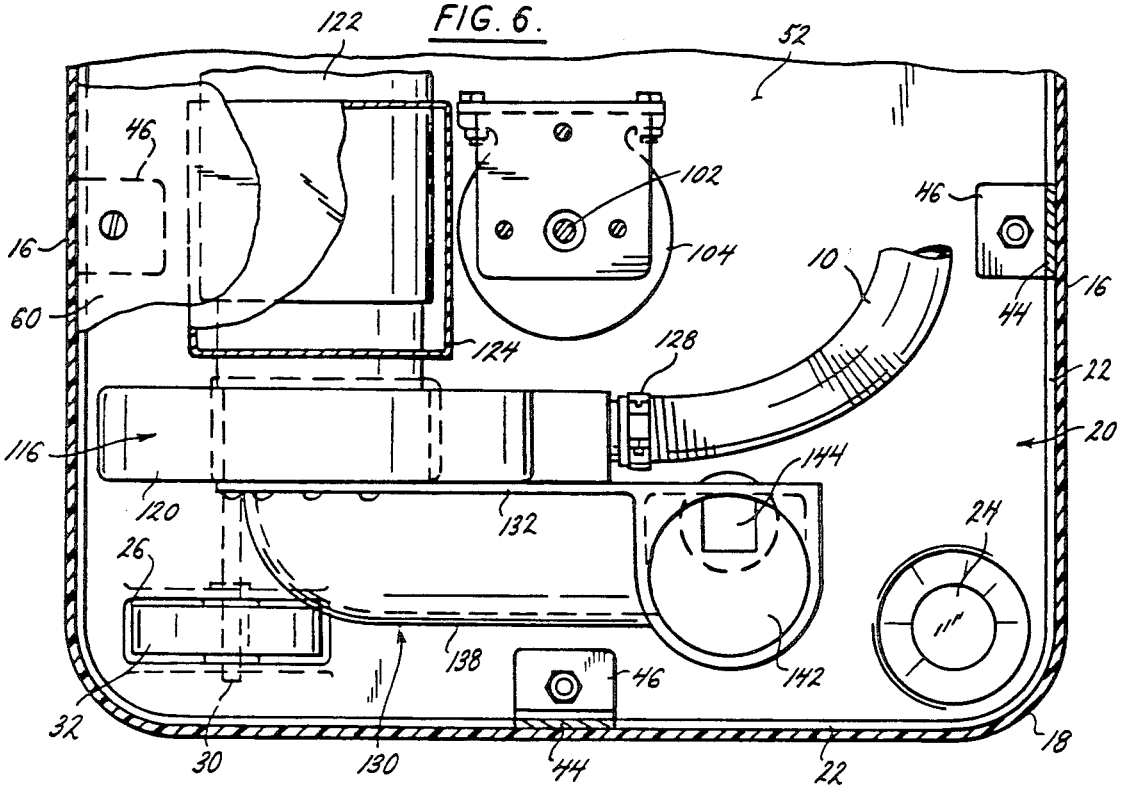
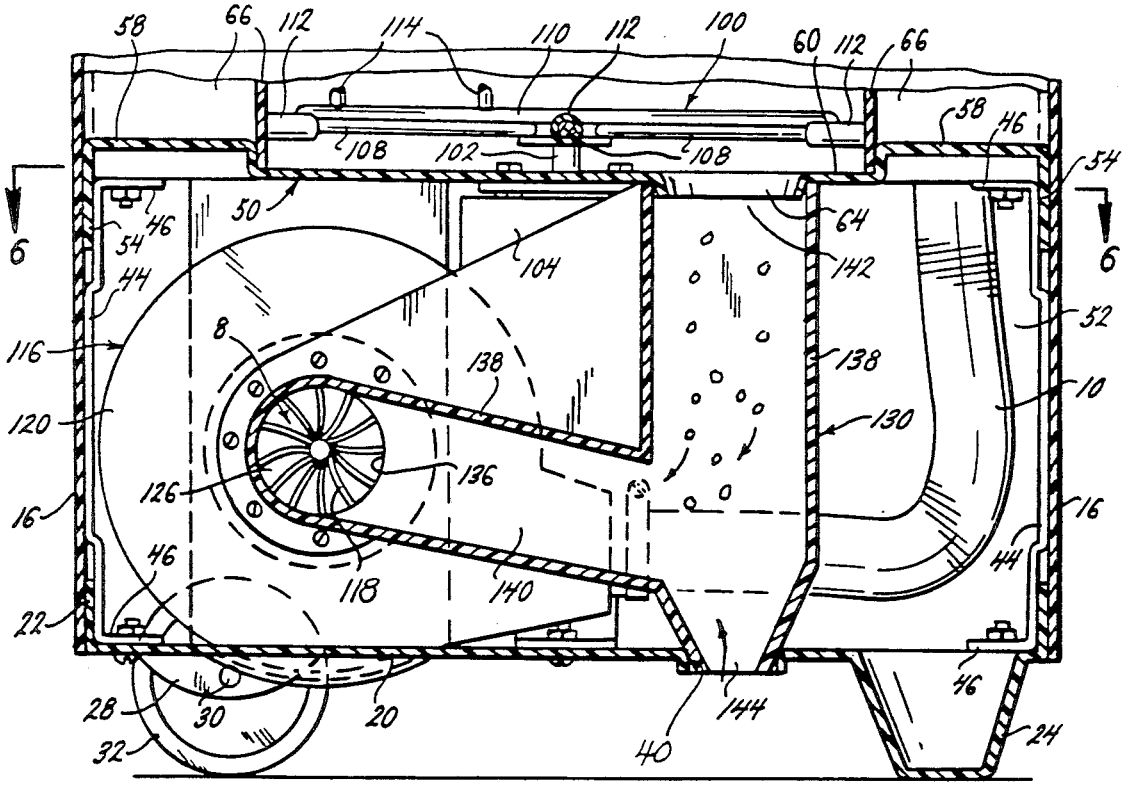
FIG. 5.

MACHINE FOR BLOWING THERMAL INSULATION

BACKGROUND OF INVENTION

This invention relates in general to the installation of thermal insulation in buildings and more particularly to a machine for blowing loose insulation into cavities in building walls, ceilings, and floors.

Thermal insulation for buildings comes in a variety of forms. For example, one can purchase bats of glass fibers that are usually installed between the studs of walls before the walls are enclosed with gypsum board or perhaps between ceiling or floor joints, or even between rafters. Rigid sheets of expanded polymers, such as Strafoam polymar, are also available, and they are usually installed against rough wall surfaces behind a finishing layer. But perhaps the most versatile of all thermal insulations are those which are loose and not attached to any backing. As such, they can be blown into cavities without destroying the finished surfaces of walls and ceilings.

Typical of the loose insulations are glass fiber and rock wool and also certain loose cellulose materials which have been treated to render them fire resistant. The former require blowing equipment so large and heavy that it must remain with the vehicle which transports it to the job site. Loose cellulose insulation requires less bulky equipment, and indeed, some of the equipment is small enough and light enough to be brought into the building where the insulation is to be blown. Even so, this equipment is not easily transported by a single individual and is usually furnished as two components, namely a hopper and a fan, which are assembled at the job site. The hopper, which delivers the loose insulation to an airstream generated by the fan, is in its own right quite heavy and bulky and thus not easily moved about the typical home. Moreover, it includes a rotor which revolves at relatively high speed to prevent the insulation from consolidating in the hopper. This rotor presents a hazard to those who use the machine. Moreover, the operator must couple the fan to the hopper unit, which in itself is a relatively complex procedure in that it requires the manipulation of unfamiliar fittings. The fan, which revolves at extremely high velocity also presents a danger, since it is exposed.

The present invention resides in a machine for directing loose insulation into the cavities of building walls, ceilings, and floors, and includes a hopper and a fan united into a single unit which is light in weight, highly compact, and easily moved about. Moreover, it requires very little skill to operate and as such may be used by the typical home owner, perhaps on rental basis.

DESCRIPTION OF THE DRAWINGS

In the accompanying drawings which form part of the specification and wherein like numerals and letters refer to like parts wherever they occur.

FIG. 5 is a sectional view of the machine taken along line 5—5 of FIG. 4 and showing the interior of the equipment cavity and also the carburetor section;

FIG. 6 is a sectional view taken along line 6—6 of FIG. 5 and showing the interior of the equipment cavity;

DETAILED DESCRIPTION

Figure 1:
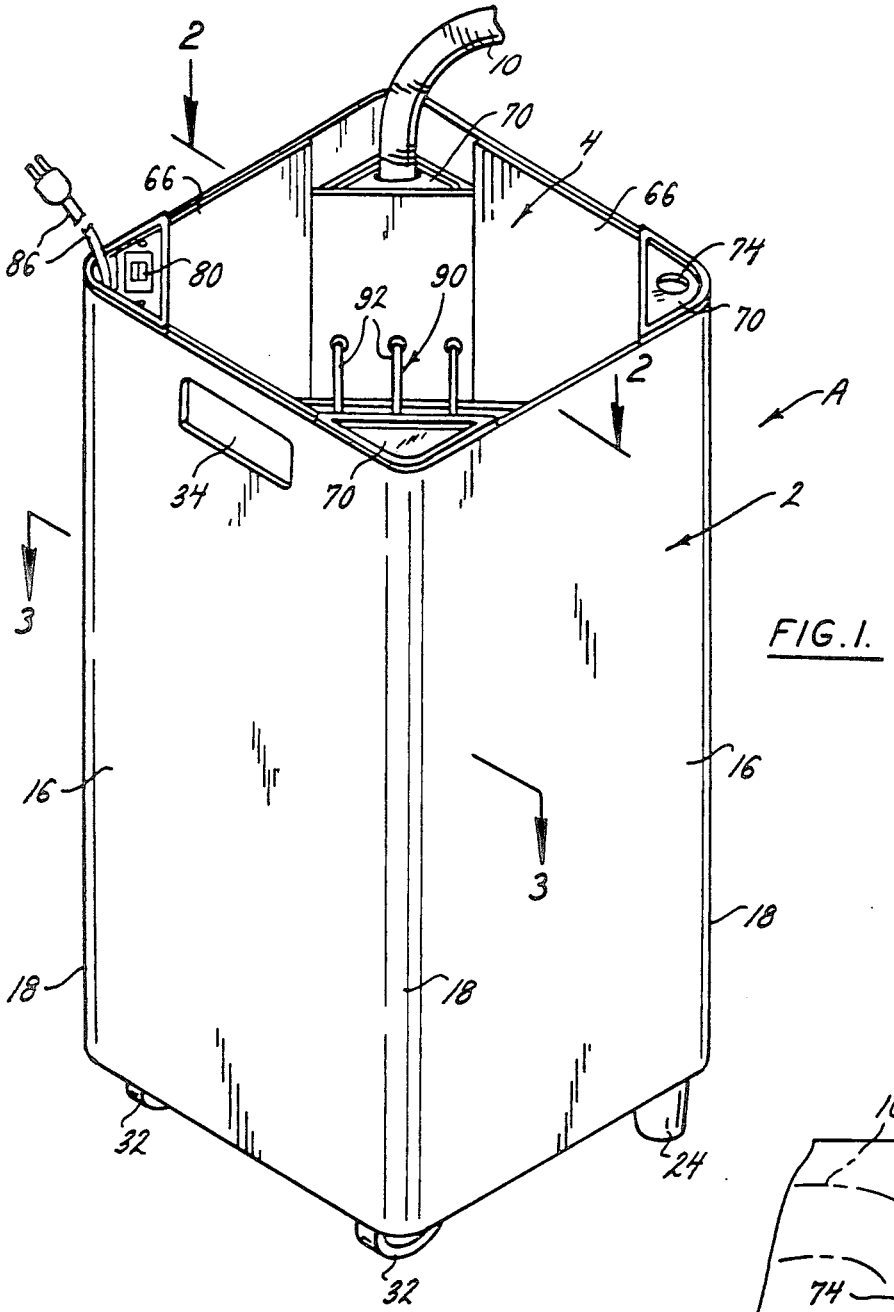
FIG. 1 is a perspective view of a blowing machine constructed in accordance with and embodying the present invention.

Referring now to the drawings, a blowing machine A (FIG. 1) for delivering a loose insulation, preferrably composed of a cellulose material, to cavities in the walls, ceilings, and floors of buildings, is light in weight and small enough to be brought easily into the typical home. Externally its surfaces are smooth and clean so that it will not snag on or damage door jambs and furniture as it is moved about. Basically, the machine A includes (FIGS. 1 & 8) a housing 2 and, within the housing 2, a hopper 4, an agitating unit 6 at the bottom of the hopper 4, and a blowing unit 8 below the hopper 4. In addition, the machine A has a hose 10 through which the loose insulation passes to be blown into the cavities of the building. Indeed, the hopper 4 provides a supply of loose insulation which is metered into an airstream generated by the blower unit 8. The blower unit 8 in turn discharges the airstream, with the insulation entrained in it, into the hose 10. While the hose 10 will normally extend a substantial distance from the housing 2 when the machine A is in use, it may be wound into a coil which fits into the hopper 4 when the machine A is stored or in transport.

The housing 2, which possesses a box-like configuration measuring approximately 19×19×38 inches, is formed from a relative strong polymer such as ABS plastic. It has four flat side walls 16 which are joined at curved corners 18 to impart a square tubular configuration to the housing 2 (FIG. 1). While the top of the housing 2 is essentially open, the bottom is closed by a lower wall or pan 20 (FIG. 8) which is molded from the same polymer. For the most part, the lower pan 20 is flat, but along its margin it has a peripheral flange 22 which projects upwardly along the inside faces of the side walls 16 and corners 18. At two of the corners along the flange 22, that is at the two corners along the front of the housing 2, the lower pan 20 has legs 24 of conical configuraion which project downwardly. At the two other corners, which are at the rear of the housing 2, the lower pan 20 has elongated cutouts 26 and slight bosses 28 (FIG. 2 & 5) which project downwardly on each side of each cutout 26 to accommodate axles 30 which extend transversely with respect to the cutouts 26 somewhat below them. The axles 30 lie along a common axis and carry wheels 32 which project upwardly through the cutouts 26 into the interior of the housing 2 and likewise downwardly below the lower pan 20 a distance that equals the projection of the legs 24. Thus, when the legs 24 and wheels 32 rest on a level supporting surface, such as a floor, the lower pan 20 is horizontal and the side walls 16 extend vertically. Near its upper margin, that side wall 16 which is at the rear of the housing 2 has a slot 34 (FIG. 1) which creates a hand grip in that wall 16. This enables one to easily grip the housing 2, tip it backwardly on its wheels 32, and move it about simply by allowing it to roll over the supporting surface on its wheels 32.

Between its two cutouts 26, the lower pan 20 has a slight depression 36 (FIG. 8) of arcuate contour which lies closer to one wheel 32 than the other. Somewhat ahead of the depression 36 is a circular aperture 40, around which the bottom of the pan 20 flares downwardly for a short distance (FIG. 4, 5 & 8).

Figure 4:
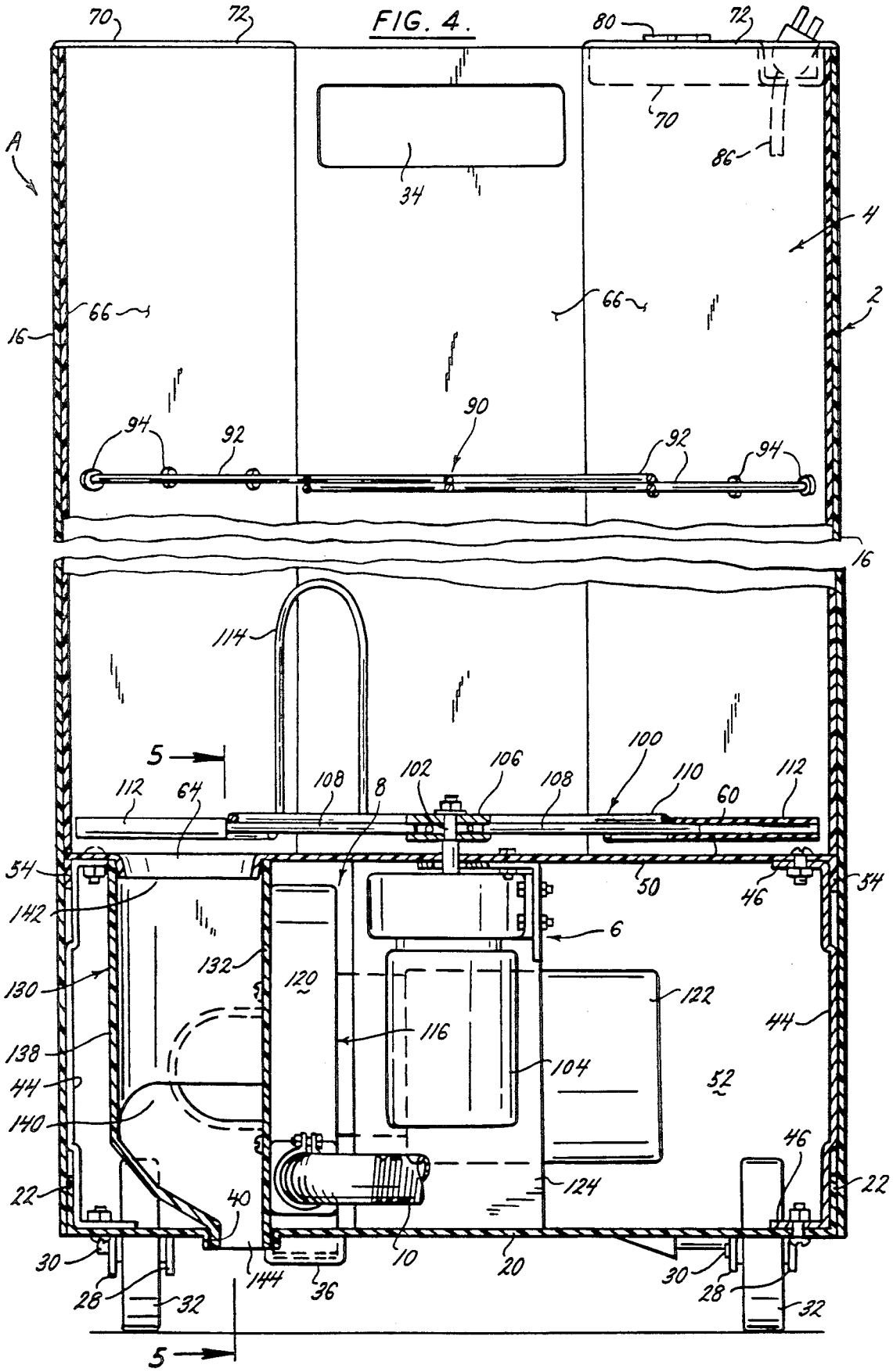
FIG. 4 is a sectional view of the machine taken along line 4—4 of FIG. 3.

The lower pan 20 is secured to the side walls 16 with its peripheral flange 22 located against the inwardly presented surfaces of the side walls 16 and corners 18 (FIG. 4 & 5). Each side wall 16 midway between the two corners 18 between which it lies is fitted with a bracket 44 having inwardly directed tabs 46, one at its upper end and the other at its lower end. Each bracket 44 in the region of its tab 46 is further offset inwardly from the side wall 16 to which it is secured. The offset at the lower tab 46 for the four brackets 44 accommodates the peripherial flange 22 for the lower pan 20, so that the major surface area of the pan 20 may be brought against the lower tabs 44, to which the lower pan 20 is fastened with screws.

In addition to the lower pan 20, the housing 2 has an upper pan 50 (FIG. 4, 5 & 8) which is likewise fastened to the brackets 44 within the side walls 16 and corners 18. The upper pan 50 rests on the upper tabs 44 of the brackets 44, so that an equipment cavity 52, the height of which equals the length of the brackets 44, exists between the two pans 20 and 50. The cavity 52 contains the blowing unit 8 and much of the agitator unit 6 as well. The upper pan 50 has a peripheral flange 54 which lies along the inwardly presented surfaces of the side walls 16 and curved corners 18 of the housing 2 and fits behind the offset portions of the brackets 44, so that the upper tabs 46 come against the major surface areas of the pan 50. Here, the pan 50 is attached to the tabs 46 with screws.

The upper pan 50 for the most part is flat, but at each of its corners it has elevated segments 58 (FIG. 5 & 8) of generally triangular configuration. The segments 58 leave the pan with an intervening flat surface of octagonal configuration, and that surface serves as a floor 60 for the hopper 4. Two of the triagular segments 58 lie above the short legs 24 in the bottom pan 20 and each of those segments contains a circular aperture 62. The floor 60, one the other hand, contains a circular air hole 64 which lies directly above the circular opening in the lower pan 20. Here the hopper 4 opens into the blowing unit 8. The floor 60 of the pan 50, in the region of its center, carries the agitating unit 6.

Figure 3:
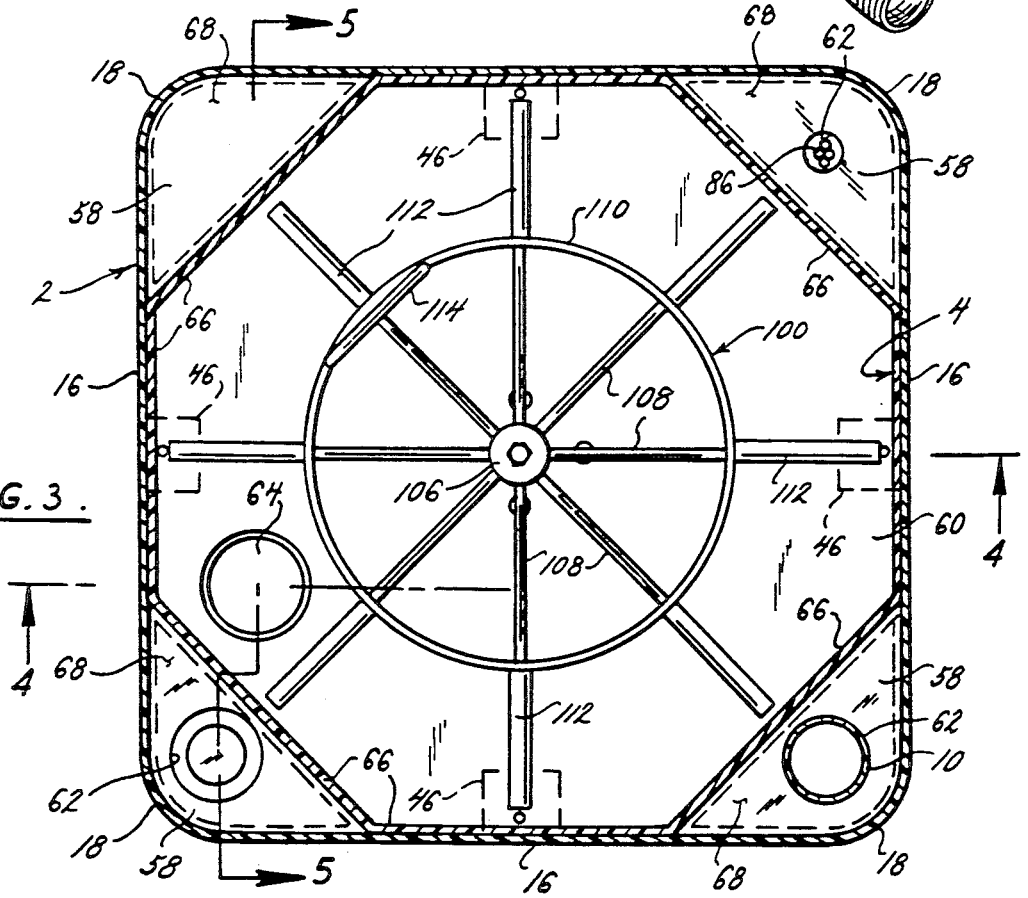
FIG. 3 is a sectional view of the machine taken along line 3—3 of FIG. 1 and showing the agitating wheel and the underlying floor of the hopper.

The hopper 4 fits into and occupies the portion of the housing 2 that lies above the octagonal floor 60 on the upper pan 50 (FIG. 4). Like the housing 2, the hopper 4 is tubular, but in cross-section it is octagonal, instead of square, and indeed it matches the shape of the octagonal floor 60 in the upper pan 50 (FIG. 3). As such, the hopper 4 possesses eight side walls 66. Four of these walls 66 lie against the inside faces of the side walls 16 for the housing 2. The remaining four walls 66 are set inwardly from the curved corners 18 of the housing 2 and at their lower ends fit inside the elevated triangular segments 58 of the upper pan 50 (FIG. 5). Thus, all eight side walls 66 extend downwardly to and have their lower edges against the floor 60 in the upper pan 50. The upper margins of the hopper side walls 66 lie flush with the upper margins of the side walls 16 and corners 18 of the housing 2, save one at the front of the housing 2. That one side wall 66 is cut away to accommodate the hose when it is coiled and stored in the hopper 4. The side wall 66 at the rear of the hopper 4 likewise was a hand slot 34.

Every other side wall 66 in the hopper 4 is set inwardly from a different curved corner 18 of the housing 2, and these side walls 66 together with the corners 18 create four corner channels 68 (FIG. 3) in the housing 2. The corner channels 68 lie directly above the elevated triangular segments 58 on the upper pan 50, and indeed, the segments 58 close the lower ends of the channels 68 and rigidify the lower end of the hopper 4. The upper ends of the corner channels 68 are fitted with caps 70 (FIGS. 1 & 2) having upwardly turned flanges 72 which fit against the inside surfaces of the curved corners 18 and the outside surfaces of the inwardly set hopper walls 66. Thus, the caps 70 serve to both close the upper ends of the corner channels 68 and to rigidify the upper end of the hopper 4.

Figure 7:
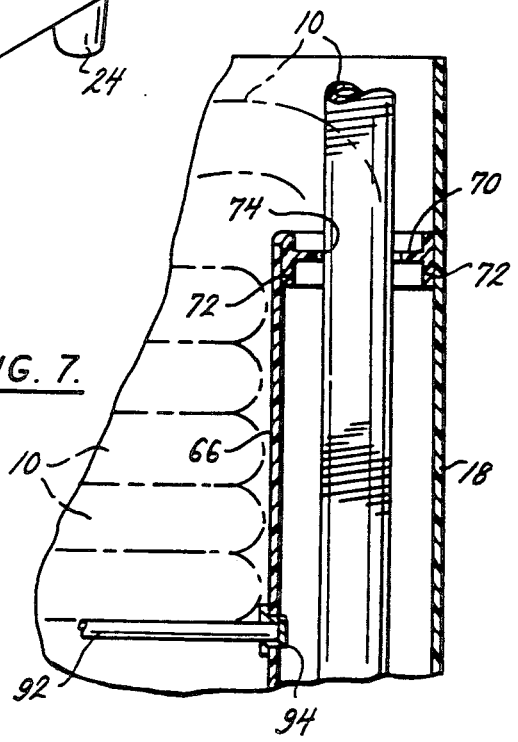
FIG. 7 is a fragmentary sectional view taken along line 7—7 of FIG. 2 and showing the corner channel through which the hose extends.
Figure 2:
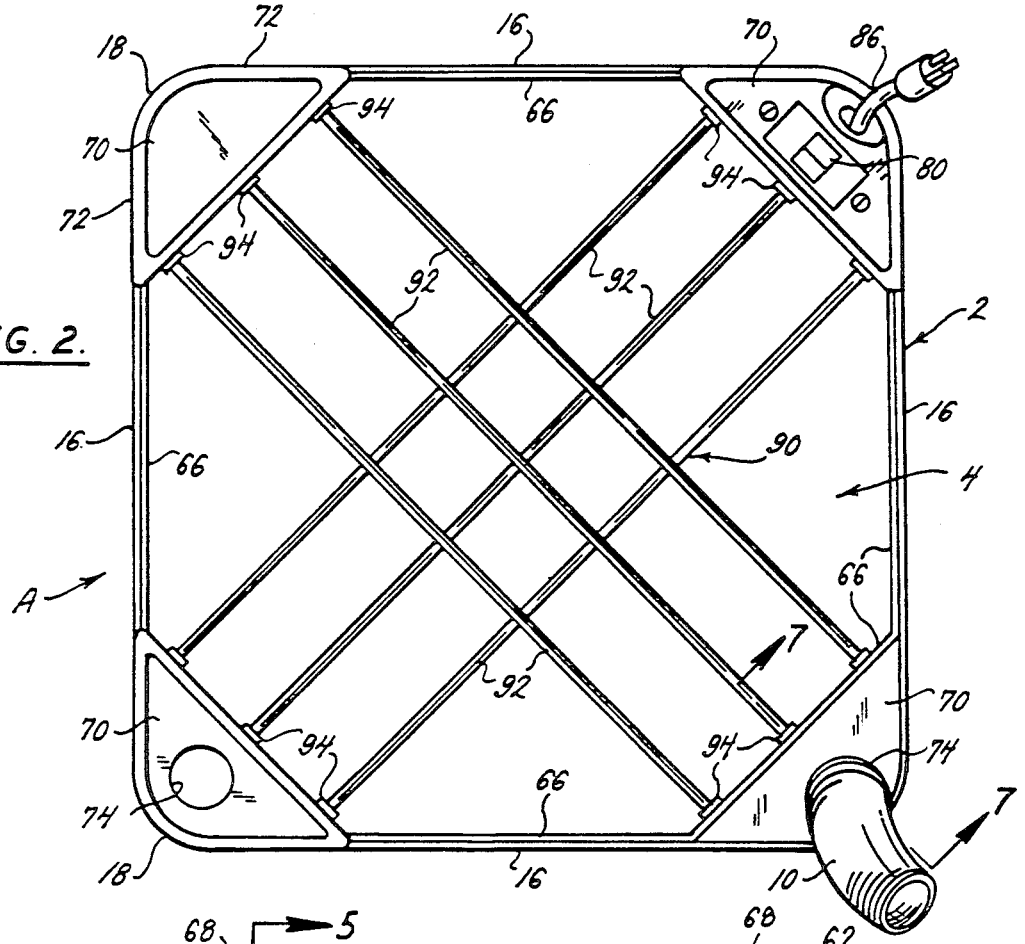
FIG. 2 is a top plan view of the blowing machine taken along line 2—2 of FIG. 1.

The two caps 70 at the front of the housing 2 contain circular apertures 74 (FIG. 2). The corner channel 68 below one of these funtions as an air vent for the equipment cavity 52 at the bottom of the housing 2, inasmuch as it is unobstructed and communicates with the cavity 52 through the circular aperture 62 in the triangular elevated segment 58 at its lower end, as well as with the exterior through the circular aperture 74 in its cap 70. The other channel 68 at the front of the housing 2 accommodates the hose 10. In this regard, one end of the hose 10 is coupled to the blowing unit 8 within the equipment cavity 52 of the housing 2 (FIG. 6). From there it passes through the aperture 62 in the other elevated segment 58 at the front of the housing 2, thence upwardly through the corner channel 68 that is above that segment 58, and out of the housing at the aperture 74 in the cap 70 at the upper end of the channel 68 (FIG. 7). The end cap 70 through which the hose 10 leaves the housing 2 is set somewhat below the common upper edge of the housing 2 and hopper 4, and this offset enables the hose 10 to turn into the hopper 2, where it may be stored, without protruding above that upper edge (FIGS. 1 & 7).

The cap 70 over one of the corner channels 68 at the rear of the housing 2 serves as a mount for the electrical controls required for the agitating unit 6 and blowing unit 8, including an off-on switch 80, a tilt switch, and a fuse (FIG. 1 & 2). The electrical energy required to operate the agitating unit 6 and bowing unit 8 is supplied through a conventional electrical cord 86 which passes out of the housing 2 at the end cap 70 containing the switch 80 and other controls. When the machine A is not in use, the cord 86 may be retracted into and stored within the channel 68.

The hopper 4 contains a grate 90 which lies closer to its upper end than the floor 60 at its lower end (FIGS. 2 & 4). The grate 90 consists of bars 92 which extend horizontally through the hopper 4 and have their ends fitted into grommets 94 in those hopper walls 66 which are set inwardly from the corners 18 of the housing 2. The bars 92 are arranged in two sets with the bars 92 of the one set extending transversely with respect to the bars 92 of the other set so as to create within the hopper 4 a barrier which restricts access to the lower region of the hopper 4. When the hopper 4 is approximately 28 inches deep, the grate 90 should be located 10 to 11 inches below its upper margin.

The agitating unit 6 includes (FIGS. 3, 4 & 8) an agitating wheel 100 which revolves in the lower portion of the hopper 4 immediately above the floor 60 of the upper pan 50. The wheel 100 is fastened to a drive shaft 102 which extends vertically through the floor 60 on the upper pan 50, it being part of an electric gear motor 104 which is suspended from the upper pan 50 and as such occupies a portion of the equipment cavity 52 between the two pans 20 and 50. The gear motor 104 is connected to an electrical circuit that is controlled by the off-on switch 80 and is protected by the tilt switch and fuse.

The agitating wheel 100 includes (FIGS. 3 & 4) a hub 106 at which it is connected to the drive shaft 102 of the gear motor 104 and spokes 108 which radiate from the hub 106, extending to and slightly beyond a ring 110, to which they are attached. Both the spoke 108 and ring 110 are formed from metal rod and are welded together to impart rigidity to the wheel 100. The ends of the spokes 108 describe a circle which lies inwardly from the feed hole 64 in the floor 60 of the upper pan 50. Each spoke 108 at its end is fitted with a flexible tip 112 which extends outwardly almost to the side walls 66 of the hopper 4. As such the tips 112 sweep over the feed hole 64. The tips 112 may be nothing more than short pieces of an elastomeric hose fitted over the ends of the spokes 108. While the tips 112 possess enough rigidity to move loose insulation over the floor 50 at the bottom of the hopper 4 and to perhaps break it up and sweep it into the feed hole 64, they are nevertheless flexible enough to bend in the presence of a more rigid object. Thus, should a hand or a finger become lodged between the margin of the feed hole 64 and one of the tips 112, the tip 112 will simply yield and not injure the hand or finger. In addition, the wheel 100 carries a riser 114 which is attached to the ring 110, projecting upwardly from that ring in a U-shaped configuration. Inasmuch as the riser 114 projects upwardly, it encounters the insulation before the spokes 108 and serves to fragment away clumps of any insulation.

Figure 8:
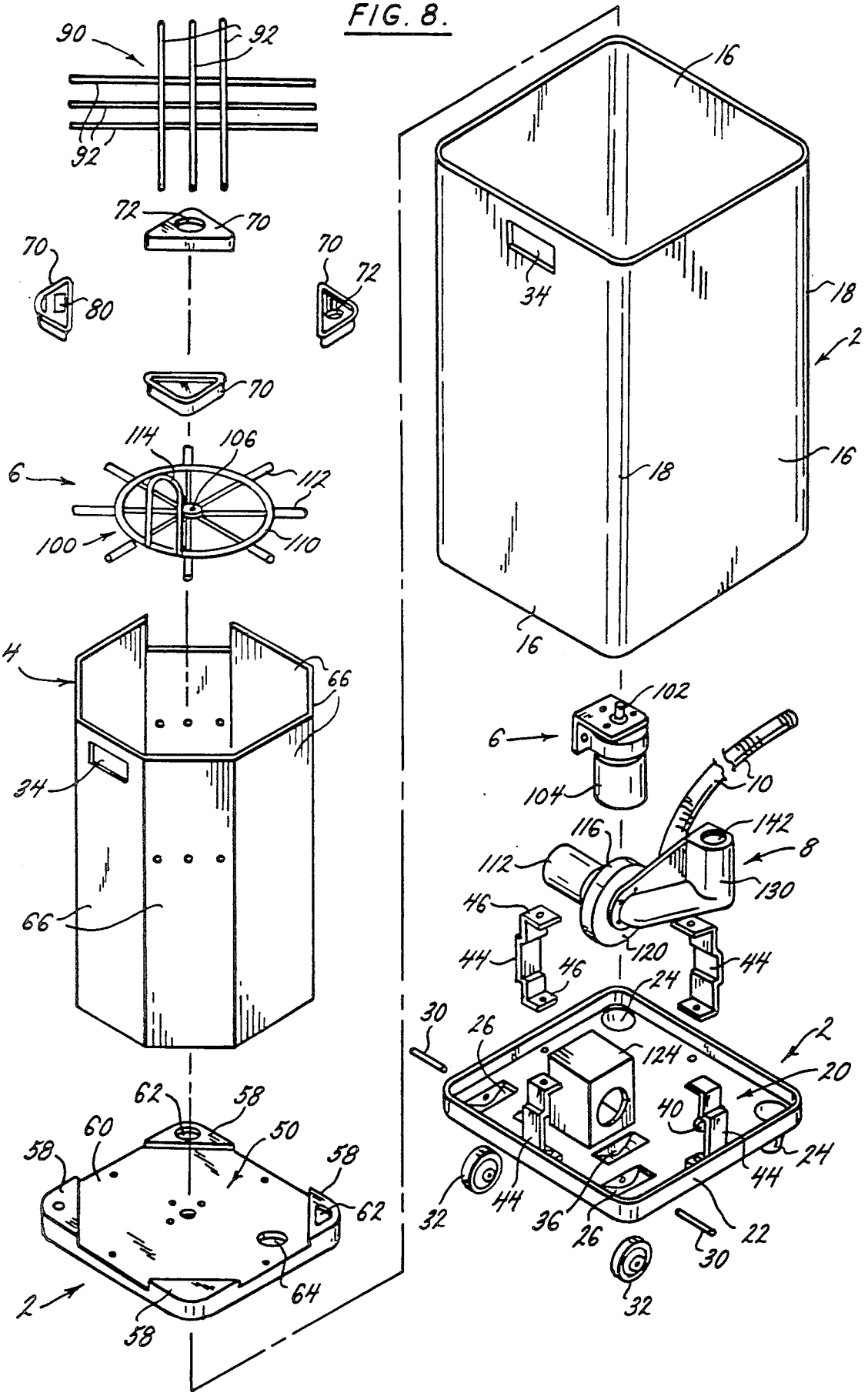
FIG. 8 is an exploded perspective view of the machine.

The blowing unit 8 also occupies the equipment cavity 52 (FIGS. 4–6) , generally in the region of the aligned air inlet 38 and feed hole 64 of the lower and upper pans 20 and 50, respectively, and also along the rear margins of the two pans 20, 50, so in a sense it wraps partially around the gear motor 104 of the blowing unit 6. It includes a fan 116 having an impeller 118 (FIG. 5) and a generally circular fan housing 120 in which the impeller 118 revolves at extremely high velocity on the order of 10,000 rev/min. The housing 120 is coupled to a motor 122 which turns the impeller 118, and that motor is contained within a metal mounting box 124 which fits between and is bolted against the lower and upper pans 20 and 50 (FIGS. 4 and 8). Actually, the mounting box 124 confines the motor 112 between the two pans 20 and 50 such that the fan housing 120 projects downwardly into and is received in the accuate depression 36 of the lower pan 20. The housing 120 of the fan 116 has a suction port 126 (FIG. 5) located along the axis of rotation for the impeller 118 and a discharge port 128 (FIG. 6) located along the periphery of the housing 120. One end of the hose 10 is connected to the discharge port 128 so that air drawn into the fan 118 at the suction port 126 is discharged into the hose 10.

Aside from that, the blowing unit 8 has a carburetor 130 (FIGS. 4–6 & 8) through which air and the loose insulation are drawn and mixed as they pass to the fan 116. The carburetor 130 lies along one side of the equipment cavity 52 and forms a conduct that leads from the feed hole 64 in the floor 60 of the upper pan 50 and from the circular opening 40 in the lower pan 20. In a broad sense, it is a T-fitting, having on one side a flat wall 132 (FIGS. 4 & 6) that is presented toward and is fastened against the fan housing 120 around the suction port 126. The carburetor 130 also has a contoured wall 138 which is presented outwardly toward the nearby side wall 16 of the housing 2. The contoured wall 138 defines a mixing chamber 140 (FIG. 5) which along one side is closed by the flat wall 132. The contoured wall 138 contains a product inlet 142 which aligns with the feed opening 64 in the floor 60 of the upper pan 50 and an air inlet 144 which registers with the circular opening 40 in the lower pan 20. Actually, the downwardly directed rim of the feed hole 64 projects into the product inlet 142, whereas the contoured wall 138 at its air inlet 144 is configured to fit into the circular opening 40 in the lower pan 20, all to maintain alignment between the feed hole 64 and product inlet 142 and between the circular opening 38 and air inlet 144. In this regard, the height of the carburetor 130 in the region of its aligned inlets 142 and 144 corresponds with the spacing between the lower and upper pans 20 and 50, so that the carburetor 130 is snugly captured between the two pans 20 and 50. In the region of its inlets 142 and 144 it cannot be displaced laterally because the rim of the feed hole 64 projects into the product inlet 142 and the contoured wall 138 projects into the circular opening 38. The product inlet 142 is considerably larger than the air inlet 144, the ratio between the cross-sectional areas of the two being between about 10 and 5 to 1 and is preferably 7 to 1.

The fan 118 of course induces an airstream in the mixing chamber 140 of the carburetor 130, and the air required to sustain this airstream enters the carburetor 130 at the air inlet 144. If the hopper 4 contains a loose insulation, it will be drawn into the product inlet 142 along with the air. This insulation mixes more thoroughly with the air in the mixing chamber 140 of the carburetor 130, whereupon it enters the fan housing 120 as part of the airstream. The fan 118 discharges the airstream and the insulation which is entrained in it into the hose 10.

The motor 122 for the fan 116 is connected into an electrical circuit which is controlled by the off-on switch 80 and protected by the tilt switch and fuse.

Operation

The blowing machine A has all of its components united into a single unit which, when stored or transported, occupies no more space than the housing 2. In this regard, the hose 10 when coiled fits into the upper portion of the hopper 4 where it rests on the grate 90. The electrical cord 86, on the other hand, retracts into the corner channel 68 over which the off-on switch 80 and other electrical controls are located. The housing 2 fits easily through door openings and need not be carried inasmuch as when tilted backwardly at a slight angle, it rests solely on its wheels 32 and may be moved about on those wheels with relative ease, much the same as objects are moved with a conventional hand truck. The hand slot 34 in the back of the housing 2 and hopper 4 provides a convenient location for gripping the housing 2 as it is tilted and moved about on its wheels 32. Having smooth side walls 16, the housing 2 possesses no projections or awkward configurations which might bump against door frames or snag on upholstery. Both the housing 2 and hopper 4, which are the largest of the major components in the machine A, are formed from a light, yet tough, polymer, and as a consequence, the weight of the overall machine A is well within the capacity of a normal individual to handle. It weighs no more than about 60 lbs.

The light weight of the machine A together with the box-like configuration of its housing 2 further facilitate the transport of the machine A to a job site or to a repair facility. It will easily fit into a light truck or van and even into the trunks of most automobiles. Moreover, it is small and light enough to fall below package size and weight limits set by parcel carriers, such as United Parcel Service.

The machine A has no separable components which must be coupled at the job site before one can blow insulation. All are united into the machine A. Indeed, even the hose 10 is permanently connected. This, of course, renders the machine A extremely easily to operate indeed, so easy that it is not beyond the capabilities of the ordinary home owner.

To install insulation in a building with the machine A, one brings the machine A to a location within the building that is close enough to the area that is to be insulated to be within reach of the hose 10. That individual then withdraws the hose 10 from the hopper 4 and extends it to the area which is scheduled to receive the insulation. The cord 86 is withdrawn from the corner channel 68 in which it is stored and and the plug at its end is inserted into an electrical receptacle. Finally, loose cellulose insulation, which is sold at retail lumber yards and hardware stroes in large bags, is dumped into the hopper 4. It passes through the grate 90 and falls to the floor 60 where it accumulates, building up in the hopper 4 until the hopper 4 is nearly full.

Then with the hose 10 extended to the building cavites into which insulation is to be blown, the switch 80 is moved to its on position. This energizes the motor 104 of the agitating unit 6 and the motor 122 for the fan 118 of the blowing unit 8. The motor 104 turns the wheel 100 of the agitating unit 6 and the spokes 108 and riser 114 churn the insulation that is immediately above the floor 60, thus breaking up any clumps that may exist. Moreover, the flexible tip 112 sweep the loose insulation past the feed hole 64 in the floor 60. The motor 122 of the fan 116, on the other hand, rotates the fan impeller 118 at extremely high velocity within the fan housing 120, thus inducing a high velocity airstream which flows through the mixing chamber 140 of the carburetor 130, through the fan housing 120, and into the hose 10. The air for the airstream enters the mixing chamber 40 primarily through the air inlet 144, but some comes through the product inlet 142, having passed through the loose insulation in the hopper 4. In any event, the fan 118 reduces the pressure within the mixing chamber 140, and this reduction in pressure draws the loose insulation that is within the hopper 4 through the feed hole 64 in the floor 60 of the upper pan 50 and the aligned product inlet 142 of the carburetor 130 into the mixing chamber 140 of the carburetor 130, along with some air. Here the insulation mixes with the greater volume of air that enters through the air inlet 144. The airstream, with the insulation entrained in it, passes into the fan housing 120 from which it is discharged into the hose 10. The airstream flows through the hose 10, likewise with the insulation entrained in it. The operator directs the free end of the hose 10 at the building cavities which require insulation, and as a consequence the airstream, upon being discharged from the hose 10, directs the insulation to and deposits it in the building cavities where the insulation builds up to establish an effective thermal barrier.

The wheel 100, which rotates quite slowly in the bottom of the hopper 4, continuously churns the insulaton immediately above the floor 60, insuring that no clumps or pockets exists. It further insures that a continuous and steady stream of insulation is directed to the feed hole 64, in that its flexible tips 112 sweep the insulation continuously toward the feed hole 64. This, agitation imparts a generally uniform or constant density to the airstream, that is it insures that the ratio of insulation to air remains essentially constant.

Should the machine A for some reason fall over onto one of the side walls 16, the tilt switch will sense the new orientation and interrupt the electrical circuit to the gear motor 104 and fan motor 122. While the grate 90 should prevent one from reaching down into the hopper 4 to the region of the wheel 100, its openings cannot be too small, lest the insulation will fail to pass through the grate 90. If one does circumvent the grate 90 and reach into the bottom of the hopper 4, the chances of sustaining an injury from the slowly revolving wheel 100 are most remote, inasmuch as the tips 112 of its spokes 108 are flexible enough to bend in the presence of a hand or finger. After all, only the tips 112, and not the rigid spokes 108, pass over the hole 64. Thus, should one lodge a finger between one of the tips 112 and the edge of the feed hole 64, the tip 112 as it passes over the hole 64 will simply yield and not injure the finger.

A small rock or piece of scrap metal may somehow become mixed with the loose insulation in the hopper 4. This object, by reason of its greater density, does not so easily become entrained in the airstream. Indeed, upon reaching the feed hole 64, it simply falls through the product inlet 142 and likewise through the aligned air inlet 144 and leaves the housing 2 through the circular aperture 40 in the lower pan 20. Since the mixing chamber 140 is inclined upwardly from the air inlet 144, the object therefore does not pass into and damage the fan 118.

This invention is intended to cover all changes and modifications of the example of the invention herein chosen for purposes of the disclosure which do not constitute departures from the spirit and scope of the invention.

What is claimed is:

1. A machine for blowing loose thermal insulation into cavities in the walls, ceilings, and floors of buildings, said machine comprising: a housing having generally smooth and uninterrupted side walls, a lower wall extending across and closing the lower end of the housing and an upper wall extending through the housing between its upper end and the lower wall, whereby the side walls, lower wall and upper wall enclose an equipment cavity in the housing, the upper wall having a feed hole; a hopper located in the housing above the upper wall of the housing and having a cross-sectional size smaller than the cross-sectional size of the housing so that at least one channel exists between the side of the hopper and the side of the housing; a first motor located in the equipment cavity of the housing and an agitating wheel located in the hopper and connected to the first motor for rotation about a vertical axis that is offset from the feed hole, the wheel having end elements which pass over the feed hole as the wheel revolves to sweep loose insulation that is within the hopper into the feed hole; a blowing unit located within the equipment cavity and including a second motor, a fan housing having a suction port and a discharge port, an impeller which is rotated by the second motor in the fan housing to generate an airstream which passes into the fan housing at the suction port and leaves through the discharge port, and a carburetor having a mixing chamber that opens into the fan housing at the suction port of the fan housing, the carburetor having a product opening which opens into the hopper through the feed hole of the hopper and an air inlet, whereby when the second motor is energized, the impeller draws air and loose insulation into the carburetor to create an airstream in which the loose insulation is entrained; and a hose extending from the upper end of the housing, the hose being in communication with the discharge port on the fan housing for the blowing unit.

2. A machine according to claim 1 wherein the hose passes through one of the channels in the housing to the equipment cavity and connects with the discharge port of the fan housing within the equipment cavity.

3. A machine according to claim 1 wherein the end elements of the wheel are flexible.

4. A machine according to claim 1 and further comprising a grate in the hopper above the agitating wheel.

5. A machine for blowing loose thermal insulation, said machine comprising: an upright housing that is box-like and has smooth substantially uninterrupted side walls, the housing having an equipment cavity at the bottom thereof; a hopper located in the housing above the equipment cavity and opening upwardly for receiving and holding loose insulation, the hopper having a feed hole at the bottom thereof; a hose extending from the housing at the upper end thereof in the region where the hopper opens upwardly; and blowing means located in the equipment cavity for generating an airstream, the blowing means including a product inlet which communicates with the hopper through the feed hole and a discharge port which is in communication with the hose, whereby loose insulation is withdrawn from the hopper, becomes entrained in the airstream, and passes into the hose while entrained in the airstream.

6. A machine according to claim 5 and further comprising an electric motor mounted in the equipment cavity of the housing, an agitating wheel located within the hopper at the bottom thereof and being connected to the motor for rotation about a vertical axis, the wheel having flexible tips which project generally radially and pass over the feed hole as the revelves.

7. A machine according to claim 6 wherein the wheel has a hub attached to the motor and spokes which radiate from the hub, but are offset from the feed hole, and the flexible tips are carried by the spokes.

8. A machine for blowing loose thermal insulation, said machine comprising: an upright housing that is box-like and substantially rectangular in cross-section, having four side walls and four corners, with the side walls being smooth and substantially uninterrupted, the housing also having an equipment cavity at the bottom thereof; a hopper located in the housing above the equipment cavity and opening upwardly for receiving and holding loose insulation, the hopper extending laterally out to at least some of the side walls of the housing, but not to all of the corners, whereby corner channels exist between the hopper and the housing at at least some of the corners of the housing; the hopper having a feed hole at the bottom thereof; a hose extending from the housing; and blowing means located in the equipment cavity for generating an airstream, the blowing means including a product inlet which communicates with the hopper through the feed hole and a discharge port which is in communication with the hose, whereby loose insulation is withdrawn from the hopper, becomes entrained in the airstream, and passes into the hose while entrained in the airstream.

9. A machine according to claim 8 wherein the hose passes through one of the corner channels of the housing and extends from the housing in the region of the open top of the hopper.

10. A machine according to claim 8 wherein the hopper is octagonal in cross-section, having eight side walls, four of which extend out to the side walls of the housing and the other four of which are set inwardly from the corners of the housing so that corner channels in the housing exist between the inwardly set side walls of the hopper and the corners of the housing.

11. A machine according to claim 10 wherein the hose extends from the housing near the upper end of one of the corner channels.

12. A machine according to claim 11 wherein the blowing means includes an electric motor, and the motor is controlled by a switch located at the upper end of one of the corner channels.

13. A machine according to claim 12 wherein the motor derives electrical current from a cord which extends from the housing at the upper end of one of the corner channels, and the cord retracts into the corner channel from which it extends.

14. A machine according to claim 8 wherein the blowing means comprises a fan having a housing provided with suction and discharge ports and an impeller located within the housing, an electric motor for turning the impeller to thereby generate an airstream which enters the housing at the suction port and leaves through the discharge port, and a hollow carburetor that opens into the fan housing at the inlet thereof, so that the airstream likewise passes through the carburetor, the product inlet being at one end of the carburetor for supplying loose insulation to the airstream, and an air inlet located in the carburetor for supplying much of the air for the airstream.

15. A machine according to claim 14 wherein the air inlet of the carburetor is directly below the product inlet of the carburetor.

16. A machine for blowing loose thermal insulation, said machine comprising: an upright housing that is box-like and has smooth substantially uninterrupted side walls, the housing including a lower wall that is connected to the side walls and closes the lower end of the housing and an upper wall which extends through the housing intermediate its ends, the housing having an equipment cavity at the bottom thereof between is lower and upper walls; a hopper located in the housing above the equipment cavity and opening upwardly for receiving and holding loose insulation, with the bottom of the hopper being formed by the upper wall of the housing, the hopper having a feed hole at the bottom thereof in the upper wall of the housing; a hose extending from the housing; blowing means located in the equipment cavity for generating an airstream, the blowing means including a product inlet which communicates with the hopper through the feed hole and a discharge port which is in communication with the hose, whereby loose insulation that is withdrawn from the hopper becomes entrained in the airstream, and passes into the hose while entrained in the airstream. wheels mounted for rotation about an axis that extends along the lower wall of the housing, such that the wheels project below the lower wall to contact a supporting surface and also project above the bottom wall into the equipment cavity; and legs projecting downwardly from the bottom wall to contact the supporting surface, the legs and wheels supporting the housing in a vertical orientation when they rest on a horizontal supporting surface.

17. A machine for blowing loose thermal insulation, said machine comprising: a housing containing an upwardly opening hopper that is capable of holding the loose insulation, the housing having sides and a generally flat and generally horizontal wall at the bottom of the hopper with the wall being provided with a feed hole; blowing means for withdrawing insulation from the hopper at the feed hole in the wall and for entraining that insulation in an airstream, and an agitating wheel located within the hopper immediately above the wall at the bottom of the hopper and having flexible tips which project outwardly generally radially with respect to the axis of the wheel, the tips being considerably more flexible than the remainder of the wheel and projecting toward, but terminating short of, the sides of the hopper so that the tips do not contact the sides of the hopper when the wheel rotates about its axis; the flexible tips being located such that they pass directly over the feed hole when the wheel rotates; drive means generally outside the hopper for rotating the wheel about its axis within the hopper; whereby the flexible tips are not likely to injure a finger or hand that enters the feed hole as the wheel revolves in the hopper.

18. A machine for blowing loose thermal insulation, said machine comprising: a housing that contains an upwardly opening hopper and encloses an equipment cavity located adjacent to the hopper, the housing also having a wall that forms the bottom of the hopper and contains a feed hole; a hose extending from the housing; a blower located in the equipment cavity for generating an airstream, the blower being separate from and mounted on the housing, the blower having an inlet port which is in communication with the feed hole in the wall at the bottom of the hopper and a discharge port which is in communication with the hose; a carburetor located beneath the wall that forms the bottom of the hopper and having a product inlet that opens into the hopper through the feed hole in the wall at the bottom of the hopper and an air inlet spaced from the product inlet, the air inlet being located directly below and substantially in alignment with the product inlet, whereby loose insulation is withdrawn from the hopper, mixes with air in the carburetor and becomes entrained in the airstream and is discharged into the hose while so entrained; and wheels on the housing at the bottom thereof to enable the machine to be moved about with relative ease.

19. A machine according to claim 18 and further comprising an agitating member located within the hopper for rotation about a vertical axis, the agitating member having flexible tips which pass close to and over the feed hole at the bottom of the hopper, and means for rotating the member.

20. A machine according to claim 18 wherein the equipment cavity is located below the hopper.

21. A machine according to claim 20 and further comprising an agitating wheel located in the hopper immediately above the wall at the bottom of the hopper, and means within the equipment cavity for rotating the agitating wheel so that the wheel loosens insulation in the hopper and enables it to migrate into the feed hole and carburetor.

* * * * *